US009513084B1

(12) United States Patent
Baugh

(10) Patent No.: US 9,513,084 B1
(45) Date of Patent: Dec. 6, 2016

(54) UNDERGARMENT WITH FIREARM HOLSTER

(71) Applicant: Randy G. Baugh, El Dorado Hills, CA (US)

(72) Inventor: Randy G. Baugh, El Dorado Hills, CA (US)

( * ) Notice: Subject to any disclaimer, the term of this patent is extended or adjusted under 35 U.S.C. 154(b) by 0 days.

(21) Appl. No.: 14/711,511

(22) Filed: May 13, 2015

Related U.S. Application Data

(60) Provisional application No. 61/993,596, filed on May 15, 2014.

(51) Int. Cl.

| | |
|---|---|
| ***A45C 1/04*** | (2006.01) |
| ***F41C 33/04*** | (2006.01) |
| ***F41C 33/02*** | (2006.01) |
| ***A41B 9/00*** | (2006.01) |

(52) U.S. Cl.
CPC ..... *F41C 33/048* (2013.01); *A41B 9/001* (2013.01); *F41C 33/0209* (2013.01)

(58) Field of Classification Search
CPC ... F41C 33/048; F41C 33/0209; A41B 9/001
USPC ..... 224/587, 194, 191, 193, 238, 243; 2/73, 2/78.1
See application file for complete search history.

(56) References Cited

U.S. PATENT DOCUMENTS 944,355 A * 12/1909 Beasley ..... F41C 33/0209 224/191
1,667,364 A * 4/1928 Wagner ..... A41C 1/00 2/71
1,930,203 A * 10/1933 Jewett ..... F41C 33/0209 224/193
2,109,734 A * 3/1938 Preneta ..... F41C 33/0209 224/244
2,558,382 A * 6/1951 Previdi ..... A63B 47/001 2/250
2,583,721 A * 1/1952 Beede ..... A61F 5/449 604/345
3,583,612 A * 6/1971 Theodore ..... F41C 33/0227 224/243
3,907,182 A * 9/1975 Bryant ..... F16B 2/185 224/670
4,029,242 A * 6/1977 Stoesser ..... A45F 5/00 224/222
4,056,218 A * 11/1977 Barna ..... A45F 5/021 224/255
4,346,827 A * 8/1982 Bianchi ..... A45F 3/14 224/243
4,579,265 A * 4/1986 Schiller ..... A45C 1/04 224/222
4,886,197 A * 12/1989 Bowles ..... F41C 33/0227 224/192
4,888,006 A * 12/1989 Beaupied ..... A61F 5/445 2/406
5,016,793 A * 5/1991 Derkatz ..... F41C 33/00 206/317

(Continued)

OTHER PUBLICATIONS www.glockstore.com; Men's Concealment Briefs by UnderTech UnderCover; Product No. T1017.

(Continued)

*Primary Examiner* — Nathan J Newhouse
*Assistant Examiner* — Jennifer N Zettl
(74) *Attorney, Agent, or Firm* — Heisler & Associates

(57) ABSTRACT

The undergarment includes a holster for holding a firearm therein. The holster includes a pouch defined by a space between an inner layer and an outer layer of fabric. The inner and outer layers are joined, such as by stitching at forward and rearward edges, but kept open at an open top and an open bottom. The open bottom is smaller than the open top to allow a barrel of a pistol to pass therethrough but to hold the remainder of the pistol within the pouch. A semi-rigid trigger guard plate can also be provided adjacent the outer layer. A magazine carrier is optionally also provided as a pouch between an outer panel and an inner panel coupled to the undergarment at a waistband thereof. Both the holster and the optional magazine carrier include padding on inner sides thereof, which padding extends up above the waistband of the underwear.

19 Claims, 3 Drawing Sheets

(56) References Cited

U.S. PATENT DOCUMENTS 5,045,018 A * 9/1991 Costanzo ..... A41C 3/08 2/73
5,058,788 A * 10/1991 Newmark ..... A45F 5/00 224/198
5,067,178 A * 11/1991 Katchka ..... A41B 9/001 2/247
D325,301 S * 4/1992 Winfrey ..... D3/222
5,148,949 A * 9/1992 Luca ..... A01K 27/006 222/175
5,172,430 A * 12/1992 Lerma-Solis ..... A41B 9/02 128/842
5,215,238 A * 6/1993 Baruch ..... F41A 17/54 224/243
5,246,153 A * 9/1993 Beletsky ..... A45F 3/14 224/192
5,400,935 A * 3/1995 Farmer ..... F41C 33/046 224/198
5,431,318 A * 7/1995 Garcia ..... F41C 33/00 2/2.5
5,465,429 A * 11/1995 Rogers ..... F41C 33/0209 2/300
5,622,295 A * 4/1997 Hellweg ..... F41C 33/0236 224/193
5,832,536 A * 11/1998 Kramer ..... A41B 9/06 2/115
5,894,976 A * 4/1999 Harper ..... A45F 5/00 224/198
5,991,925 A * 11/1999 Wu ..... A41D 13/0012 2/102
6,202,222 B1 * 3/2001 Robbins ..... A41B 9/001 2/400
6,398,089 B1 * 6/2002 Har-Shen ..... F41C 33/0209 224/192
6,814,270 B2 * 11/2004 Mason ..... A45F 5/00 224/587
7,631,368 B1 * 12/2009 Samson ..... F41C 33/02 2/115
7,738,965 B2 * 6/2010 Phillips ..... A61N 1/3787 224/604
D658,364 S * 5/2012 Davis ..... D3/222
8,177,108 B1 * 5/2012 Kincaid ..... F41C 33/0209 224/193
8,235,263 B1 * 8/2012 Yeates ..... F41C 33/0227 224/193
8,328,058 B2 * 12/2012 Wilson ..... A45F 3/005 224/243
D681,943 S * 5/2013 Beard ..... D3/222
8,458,819 B1 * 6/2013 Hoole ..... A41B 9/001 2/247
8,484,765 B2 * 7/2013 French ..... A41D 27/20 2/250
8,486,035 B1 * 7/2013 Arce ..... A61F 5/449 2/227
8,522,367 B2 * 9/2013 French ..... A41D 27/20 2/250
2001/0032406 A1 * 10/2001 Yirmiyahu ..... F41C 33/0227 42/70.11
2002/0158095 A1 * 10/2002 Vor Keller ..... E05B 47/0603 224/244
2005/0035163 A1 * 2/2005 French ..... F41C 33/0227 224/243
2005/0224537 A1 * 10/2005 Rassias ..... F41A 17/02 224/243
2006/0196907 A1 * 9/2006 Pruitt ..... A45F 5/00 224/587
2007/0102461 A1 * 5/2007 Carstens ..... A41D 13/005 224/222
2007/0163164 A1 * 7/2007 Avrahami ..... F41C 33/0227 42/87
2007/0250980 A1 * 11/2007 Pellerin ..... A41B 9/02 2/69
2008/0010716 A1 * 1/2008 Brown ..... A41B 9/023 2/78.1
2008/0110947 A1 * 5/2008 Pikielny ..... F41C 33/0209 224/243
2008/0188889 A1 * 8/2008 Dedo ..... A61B 17/1322 606/203
2008/0229485 A1 * 9/2008 Cooper ..... A41F 11/16 2/306
2009/0001117 A1 * 1/2009 Rassias ..... F41C 33/0236 224/673
2009/0321480 A1 * 12/2009 Kincaid ..... F41C 33/0263 224/243
2010/0050312 A1 * 3/2010 French ..... A41D 27/20 2/69
2010/0108728 A1 * 5/2010 Castaneda ..... F41C 33/0209 224/243
2010/0281595 A1 * 11/2010 Gernes ..... A41B 9/001 2/69
2011/0004978 A1 * 1/2011 Gwaltney ..... A41B 9/001 2/402
2011/0030126 A1 * 2/2011 French ..... A41D 27/20 2/250
2011/0226825 A1 * 9/2011 Sanford ..... F41C 33/048 224/243
2011/0247127 A1 * 10/2011 Pou ..... A41D 13/0012 2/227
2013/0320055 A1 * 12/2013 King ..... F41C 33/02 224/243
2014/0014699 A1 * 1/2014 Larko ..... F41C 33/041 224/587
2014/0027485 A1 * 1/2014 Van Heusen ..... F41C 33/0209 224/587
2014/0075650 A1 * 3/2014 Garrison ..... A45F 5/021 2/300
2014/0131410 A1 * 5/2014 Looper ..... F41C 33/048 224/587
2015/0020287 A1 * 1/2015 Liu ..... A61N 1/0408 2/69
2015/0074871 A1 * 3/2015 Emich ..... A41D 27/20 2/228

OTHER PUBLICATIONS www.glockstore.com; Men's Concealment Shorts by UnderTech UnderCover; Product No. T0479.

* cited by examiner

UNDERGARMENT WITH FIREARM HOLSTER

CROSS-REFERENCE TO RELATED APPLICATIONS

This application claims benefit under Title 35, United States Code §119(e) of U.S. Provisional Application No. 61/993,596 filed on May 15, 2014.

FIELD OF THE INVENTION

The following invention relates to undergarments for wearing about the waist. More particularly, this invention relates to underwear garments which include a firearm holster incorporated thereinto.

BACKGROUND OF THE INVENTION

Handguns, such as pistols, are in certain circumstances carried in a concealed manner by a person. Concealment of the firearm can be beneficial for law enforcement or for individuals authorized by appropriate government authorities to carry a concealed weapon.

Various different holsters are known in the prior art for holding a pistol at a variety of different positions and in different orientations upon a person. For instance, holsters which conceal a pistol can be in a form generally worn about shoulders of the wearer or upon the leg of the wearer. The holster provides a basic function of supplying a support housing into which the pistol can be effectively carried. The holster is held relatively secured to the person and provides a pouch shaped to receive a portion of the pistol therein. The pistol can thus be easily inserted into the holster and removed from the holster when necessary.

One category of concealed holster for a pistol is provided adjacent a belt/waist of a person. General examples of holsters which facilitate support of a pistol adjacent a belt, hips or mid-torso of a person are included in U.S. Pat. Nos. 5,465,429, 5,832,536 and 8,522,367 and Published Patent Application Nos. 2007/0250980, 2013/0320055 and 2014/0014699. Furthermore, in at least one instance it has been known in the prior art to provide a holster integrated into underwear "briefs" for supporting a pistol therein.

Various problems are encountered when incorporating a holster into underwear. It is desirable that a grip of the pistol be available for a user to quickly grasp the pistol. To facilitate such grasping of the grip of the pistol, the grip of the pistol is typically positioned above a waistband of the underwear. However, this leaves the grip and portions of the pistol adjacent the grip in direct contact with the skin of the wearer above the waist. This is both uncomfortable and to some extent presents an opportunity for injury. Also, transfer of moisture and/or oils from the skin can damage the firearm and/or ammunition. Furthermore, it is desirable that not only a holster be provided for a pistol, but that also some form of magazine carrier also be provided for carrying of an ammunition magazine for use with the pistol. Accordingly, a need exists for an improved pistol holster attachable to underwear.

SUMMARY OF THE INVENTION

With this invention an undergarment is provided which includes a firearm holster therein and optionally also a magazine carrier. The undergarment generally includes a waistband and with fabric extending down from the waistband following a variety of known different underwear fabric panel construction designs. A firearm holster, typically for a pistol, is coupled to the waistband. Most typically the holster is located at a corner between a rear side of the waistband and a lateral side of the waistband. Most typically the holster would be located at the right rear side as most individuals are right handed, but a left handed undergarment could be provided.

The holster is generally provided as a pouch formed as an open space between an inner layer of fabric and an outer layer of fabric. Preferably, the inner layer and outer layer are provided separate from the fabric from which the undergarment is made, but one of the inner and outer layer (typically the inner layer) could be provided as part of the undergarment fabric extending down from the waistband. The inner layer and outer layer are joined together at forward and rearward edges thereof but are not joined together at an open top and are also preferably not joined together at an open bottom. According to one embodiment, these layers of fabric are joined together by stitching at the forward and rearward lateral edges.

The bottom opening is smaller than the top opening. In one embodiment the bottom opening is made smaller by having the rearward stitching transition into contour stitching which curves along a path causing it to be closer to the forward edge of the pouch as this stitching extends downward. The contour stitching causes the bottom opening to be sufficiently small so that only a barrel of a handgun can extend therethrough, and not the entire handgun.

Padding is preferably provided along with the holster. This padding could be part of the inner layer of fabric, but preferably is a separate layer of extra padded material sewn to the inner layer or otherwise attached thereto. This padding extends over the waistband and above the waistband so that a padded skin contacting surface of the padding is provided, isolating at least portions of a handgun or other firearm extending above the waistband from contact with skin of the wearer.

The holster also preferably includes an at least semi-rigid trigger guard adjacent the outer layer of fabric forming the holster. This trigger guard is most preferably in the form of a planar sheet of semi-rigid material, such as a layer of thick (e.g. near or greater than one millimeter thick) polyethylene or polypropylene plastic. The trigger guard preferably has a contour similar to that of the pouch. Thus, the trigger guard has a larger top edge than a bottom edge. The top edge is preferably larger than the open bottom of the pouch of the holster so that the trigger guard can be held within the pouch and adjacent the outer fabric layer without falling out through the open bottom. Preferably, a flexible capture panel is sewn to or otherwise attached to the outer panel at an upper edge thereof and extending downward slightly parallel with the outer panel so that a small capture space is provided at an upper edge of the outer panel which can capture the top edge of the trigger guard. This capture panel is sufficiently flexible to allow for the trigger guard to be readily inserted and removed from adjacent the outer panel.

The optional magazine carrier generally has a form similar to a magazine to be carried, such that it is generally rectangular and formed from an outer panel opposite an inner panel similar to the inner and outer layers of the holster. Similarly, inside padding is preferably provided along with the magazine carrier in a similar configuration to the inside padding of the holster, such that the magazine is largely kept from coming into contact with skin of the wearer. A lower end of the magazine carrier is preferably provided with a closure structure so that a lower portion of the magazine carrier can be selectively closed off. In this manner, a shorter magazine can still have a portion thereof sticking up out of an open top of the magazine carrier for ease in grabbing the magazine, both for short and long magazines. In one embodiment, this shortening closure is in the form of complemental hook and loop fasteners attached to similar portions of the outer panel and inner panel facing each other near a lower end of the pouch of the magazine carrier. When attached, the pouch is shortened. When a long magazine is pushed down the size adjustor opens and the long magazine can extend down to the closed bottom of the magazine carrier.

OBJECTS OF THE INVENTION

Accordingly, a primary object of the present invention is to provide a comfortable undergarment which can also comfortably carry a pistol or other firearm in a concealed fashion therein.

Another object of the present invention is to provide an undergarment which includes a firearm holster which allows a user to have quick access to the firearm when needed.

Another object of the present invention is to provide an undergarment with a pistol holster therein which includes padding to isolate the piston from coming into contact with the skin of the wearer in any great degree.

Another object of the present invention is to provide an undergarment which includes both a firearm holster and a magazine holster so that the underwear can simultaneously carry both a firearm and magazine for reloading of the firearm.

Another object of the present invention is to provide an undergarment with firearm holster therein which allows a pistol or other firearm to be carried by a person in a concealed fashion.

Other further objects of the present invention will become apparent from a careful reading of the included drawing figures, the claims and detailed description of the invention.

DESCRIPTION OF THE PREFERRED EMBODIMENT

Figure 2:
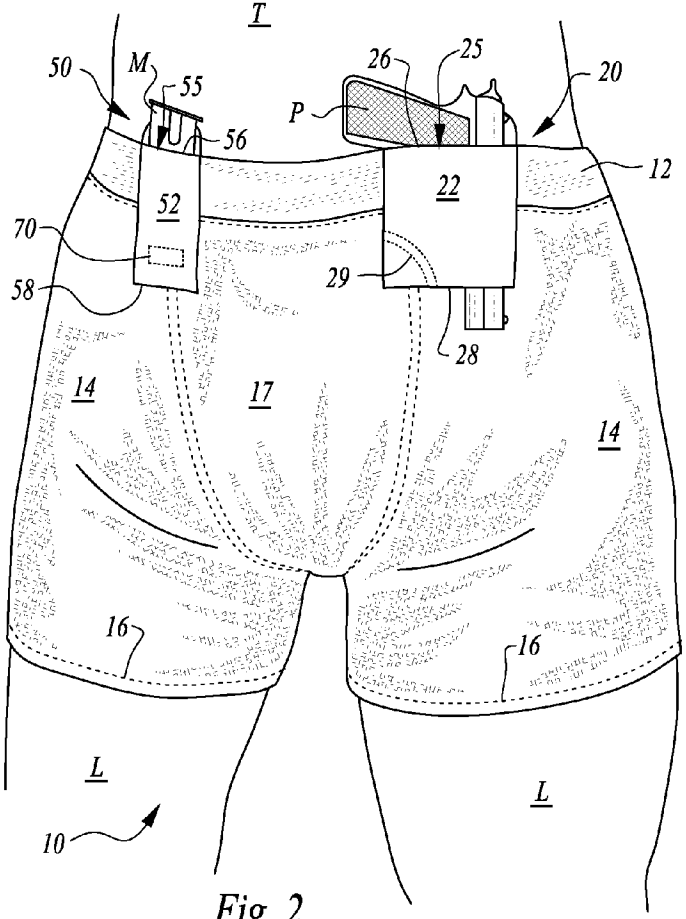
FIG. 2 is a rear perspective view of that which is shown in FIG. 1, shown worn by a wearer and also showing a pistol and magazine stored within the holster and magazine carrier thereof.
Figure 1:
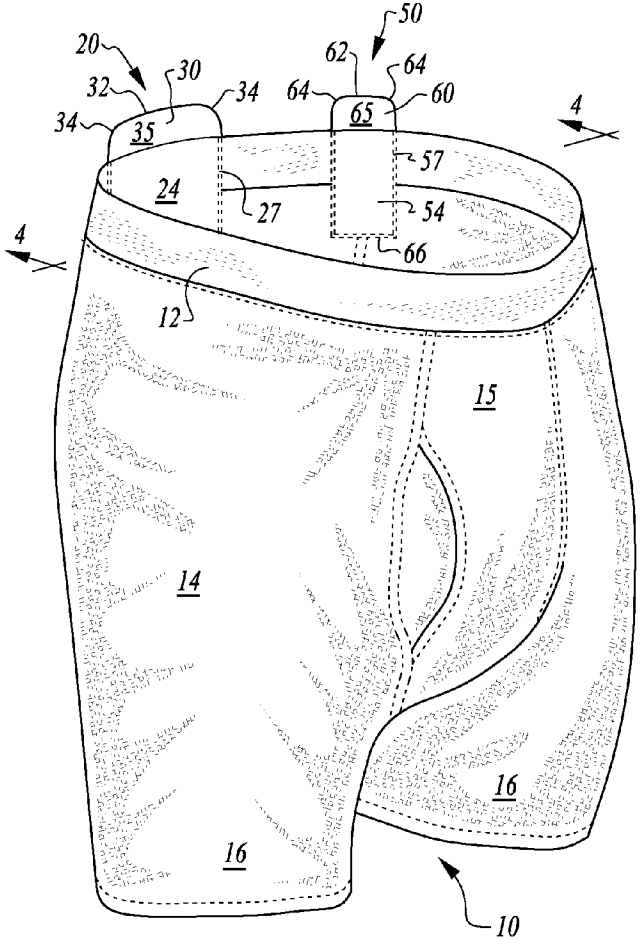
FIG. 1 is a perspective view of the undergarment according to one embodiment of this invention, with a holster and magazine carrier coupled thereto.
Figure 3:
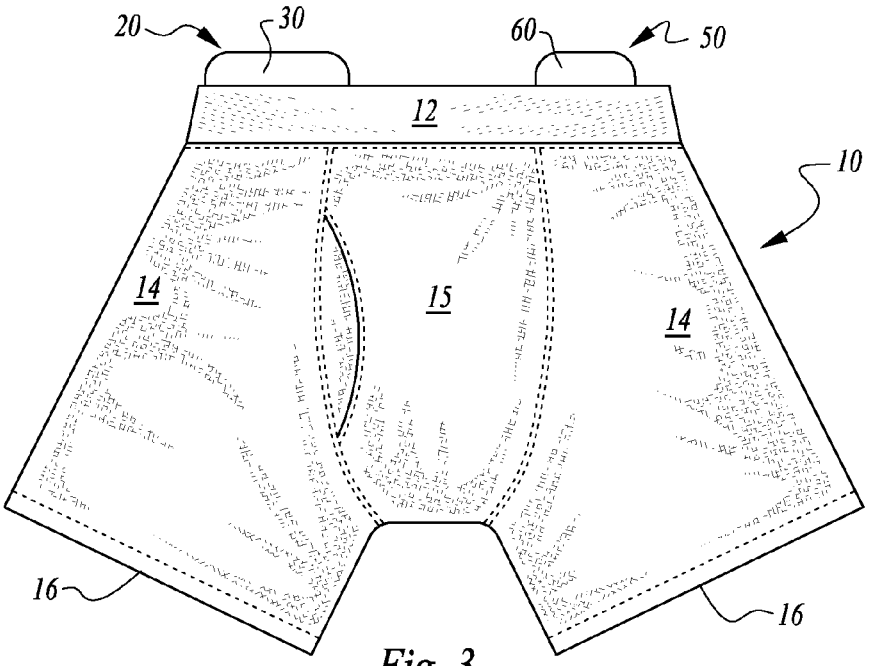
FIG. 3 is a front elevation view of the undergarment of this invention.
Figure 4:
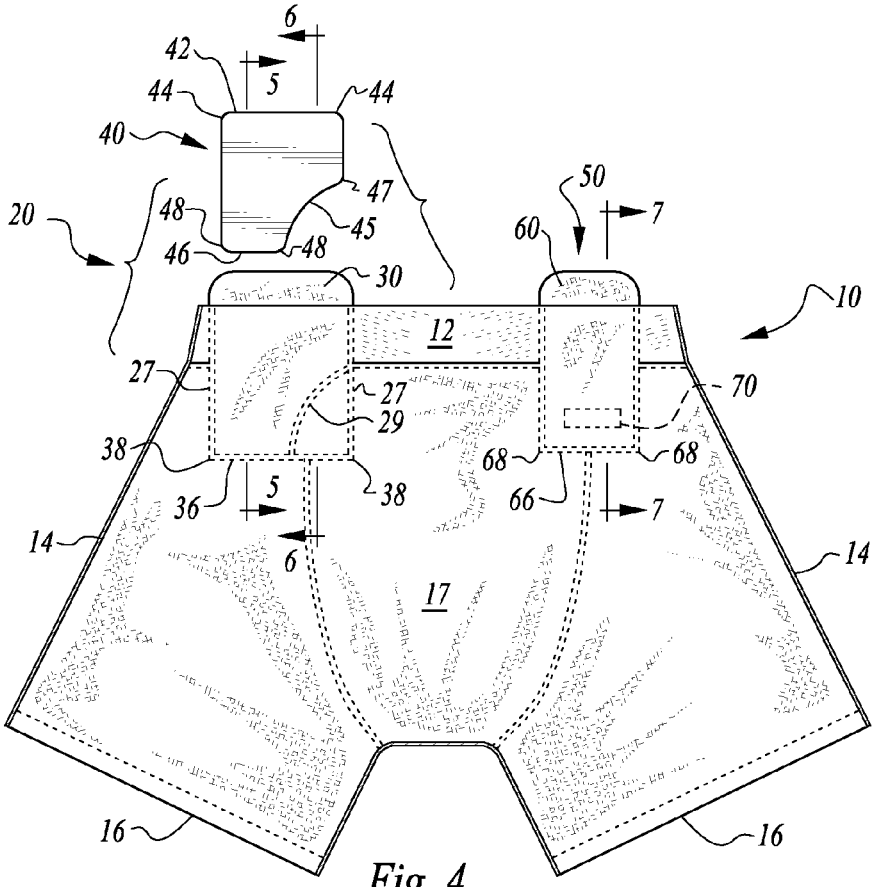
FIG. 4 is a front elevation full sectional view of that which is shown in FIG. 3, and with a pistol guard portion thereof shown exploded out of a holster portion thereof.

Referring to the drawings, wherein like reference numerals represent like parts throughout the various drawing figures, reference numeral 10 is directed to an undergarment (FIGS. 1 and 2) including a holster 20 therein and optimally also a magazine carrier 50. In essence, and with particular reference to FIGS. 1 and 2, the underwear 10 includes an integrated pistol holster 20 and preferably also a magazine carrier 50, in a manner which is both secure and comfortable, and also provides ready access to the pistol P. Underwear 10 of a variety of different types can have the details of this invention incorporated thereinto. Such underwear 10 typically has a waistband 12 defining an upper edge of the underwear 10 and which girds a torso T of the wearer. Fabric then extends down from this waistband 12 to provide further portions of the underwear 10. The holster 20 preferably has inside padding 30 which extends above the waistband 12 to protect skin of a wearer. The holster 20 also preferably has a trigger guard 40 in the form of a layer of semi-rigid material on an outer portion of the holster 20. The magazine carrier 50 also preferably includes inside padding 60 and a size adjustor 70 to control depth of the magazine carrier 50.

More specifically, and with particular reference to FIGS. 1-4, this invention generally provides two structures including a holster 20 and a magazine carrier 50. In a preferred embodiment, the holster 20 is provided on one side of the underwear adjacent the waistband 12 and the magazine carrier 50 is provided on an opposite side of the underwear 10 also adjacent the waistband 12. As an alternative, the holster 20 could be provided without the magazine carrier 50.

The holster 20 includes a pouch 25 which is shaped to receive mid-portions of a pistol P therein. A barrel portion of the pistol extends through this pouch 25 and out a lower end of this pouch 25. A grip portion of the pistol remains above this pouch 25. The pouch 25 is defined by a pair of flexible panels including an outer panel 22 and an inner panel 24, which provide a preferred form of inner and outer layers of the holster 20. In one embodiment, the inner panel 24 is provided by at least portions of the underwear 10 itself, so that only the outer panel 22 is newly provided to define the pouch 25 of this invention. In another embodiment, portions of the inner panel 24 are provided by the waistband 12 and other portions of the underwear 10, such as portions of fabric panels 14, with only the inner panel 24 being newly provided to define the pouch 25 of this invention. In a preferred embodiment, both the inner panel 24 and the outer panel 22 are newly provided to define the pouch 25 of the holster 20, separate from the waistband 12 and other portions of the underwear 10. The underwear 10 can be in any of a variety of configurations, including being more tight like "briefs" or being more loose like "boxers." The underwear 10 includes fabric panels 14 defining a front 15 and rear 17 of the underwear 10 and extending down to lower hems 16 through which legs L of the wearer can pass.

The inner panel 24 and outer panel 22 are generally parallel to each other and sufficiently flexible and attached in such a way that a pouch 25 space is provided between the inner panel 24 and the outer panel 22. Preferably, perimeter edges of the inner panel 24 and outer panel 22 are attached together, such as by perimeter stitching 27, except at an open top 26 and an open bottom 28. The open top 26 is larger than the open bottom 28, with the open bottom 28 large enough to allow the barrel of the pistol P to extend therethrough and the open top 26 large enough to allow the grip portion of the pistol P to extend up above the open top. Forward and rearward edges of the pouch are preferably defined by the inner panel 24 and outer panel 22 being sewn together or otherwise attached to each other. The open bottom 28 is made smaller than the open top 25 by having contour stitching 29 at a second lateral side opposite a first lateral side and which joins the outer panel 22 to the inner panel 24 following a path which seals off a greater portion of the open bottom 28 than of the open top 26.

While the inner panel 24 and outer panel 22 are defined as separate structures sewn together, it is conceivable that the inner panel 24 and outer panel 22 could be formed together as tubular fabric, or only sewn along one edge with a fold line defining the other edge, and still provide the basic structure of a pouch 25 defined by an inner panel 24 spaced from an outer panel 22, with the pouch 25 space therebetween.

The holster 20 also includes interior padding 30 to isolate all (or at least significant portions) of the handle of the pistol P from coming into contact with skin of the wearer above the waistband 12 at the torso T. This interior padding 30 is preferably sewn to an inside surface of the underwear 10 inside of the waistband 12. As an alternative, the interior padding 30 could be provided adjacent an outside surface of the waistband 12 but inside of the holster 25. The interior padding 30 extends up above the waistband 12 by a distance generally similar to a height of the grip of the pistol P when the pistol P resides within the pouch 25 of the holster 20. For a typical pistol this requires the interior padding 30 to extend approximately one to two inches up to an upper edge 32 above the waistband 12. This interior padding 30 typically extends down some distance below the upper edge 32 to facilitate stitching of the interior padding 30 to the waistband 12 and securely holding the interior padding 30 to the waistband 12.

The interior padding 30 is preferably a moderately thick padded material, such as two quilted layers of fabric with some form of batting or stuffing therebetween to provide a thickness of the interior padding 30. In one embodiment, the interior padding 30 has approximately one-eighth of an inch of thickness. Fabric forming the interior padding 30 is preferably selected to be soft and provide maximum comfort for the wearer, such as being formed of cotton. Other fabric materials (or material blends) could also be selected, preferably emphasizing comfort for at least a skin surface 35 of the interior padding 30 opposite a pistol surface 37. The upper edge 32 preferably curving corners 34 and extends down to a lower edge 36 with square corners 38 even with a bottom of the holster 20.

Most preferably, the pouch 25 of the holster 20 is provided with a rigid trigger guard 40 insert which can removably or permanently fit therein. The trigger guard 40 has a shape similar to that of the pouch 25 of the holster 10, but slightly smaller in perimeter dimensions, so that the trigger guard 40 can entirely fit within the pouch 25 of the holster 20. This trigger guard 40 is a semi-rigid structure which in one embodiment is planar and formed of an about one millimeter thick polyethylene or polypropylene plastic and has a perimeter closely matching that of mid-portions of the pistol P between the grip and the barrel, and especially overlying a trigger area on the pistol P. In another embodiment, the trigger guard can be shaped to have a contour wrapping around a particular pistol P style and size. This trigger guard can be inserted into the pouch 25 and provides a rigid recess into which the pistol P can be placed. Because pistols P have different geometries at mid-portions thereof, the trigger guard can be molded to a particular pistol P or can be provided by pistol manufacturers or by aftermarket third parties with specific trigger guards provided for specific known pistols P in this alternative embodiment.

The trigger guard 40 provides the basic function of further protecting against the possibility of inadvertent discharge of the pistol P. It includes a top edge 42 between top corners 44 and a bottom edge 46 between bottom corners 48. An arc 45 leads to a side corner 47 that allows the trigger guard 40 to follow the contour stitching 29. The outer panel 22 includes a capture panel 23 at an upper edge thereof which is flexible and allows the top edge 42 of the trigger guard 40 to be captured therein and held adjacent to the outer panel 22.

With this invention, a magazine carrier 50 is also preferably provided. The magazine carrier 50 is most preferably provided on a side of the underwear 10 opposite the holster 20. For instance, if the holster 20 is provided at a right side, the magazine carrier 50 will be provided at the left side. The magazine carrier 50 is an elongate closed pouch 55 including an outer panel 52 and an inner panel 54 attached together about a periphery thereof, such as with perimeter stitching 57 and defining a magazine pouch 55 between the inner panel 54 and the outer panel 52. One of these panels 52, 54 could be provided by the waistband 12 and other adjacent portions of the undergarment 10. An at least partially closed bottom 58 of the magazine carrier 50 is sewn at least partially closed as well, so that access into the pouch 55 within the magazine carrier 50 is only provided through an open top 56 of the pouch 55. The pouch 55 is close to, but preferably shorter than a length of the magazine M to be held therein, so that the magazine M sticks up out of a top of the pouch 55. As with the holster 20, panels 52, 54 or other layers of the magazine carrier 50 could be formed as a tubular structure or as one planar layer folded over to provide the panels 52, 54 or other layers. But preferably the panels 52, 54 are separate and sewn together at forward and rearward edges thereof.

Interior padding 60 is preferably provided adjacent the magazine carrier 50 which extends up above the waistband 12 of the underwear 10 by a distance sufficient to isolate a magazine M within the magazine carrier 50 from coming into contact with skin at the torso T of the wearer. In a typical embodiment this interior padding 60 extends to an upper edge 62 about one to two inches above the waistband 12. The interior padding 60 can have similar characteristics as the interior padding 30 associated with the holster 20, such as with curving upper corners 64 and with a lower edge 66 between the square corners 68 at the bottom edge 46. The padding 60 includes a skin surface 65 opposite a magazine surface 67. Specific dimensions relating to height and width of the magazine carrier are selected to allow for holding of a magazine M therein, the magazine M being of a type which cooperates with the pistol P to allow for loading of the pistol P with the magazine M.

Figure 8:
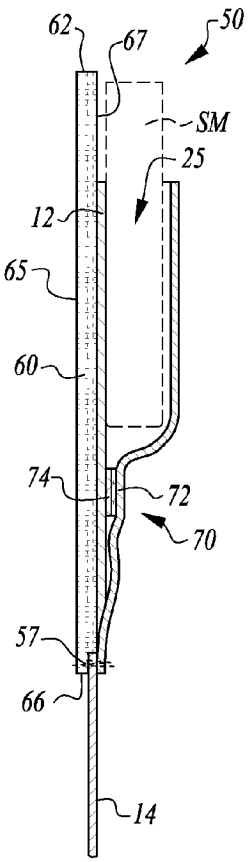
FIG. 8 is a sectional detail alternative of that which is shown in FIG. 7, showing a short magazine carried within the magazine carrier and with a size adjuster in a closed configuration.
Figure 7:
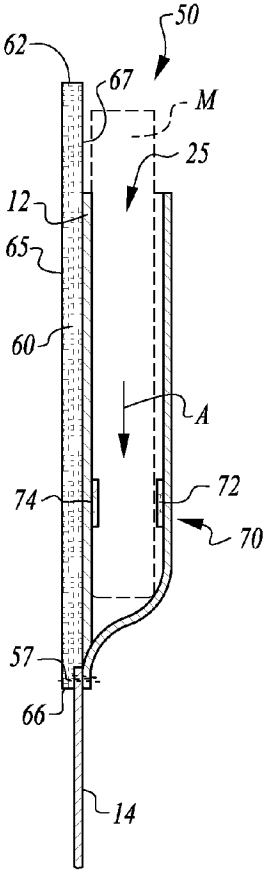
FIG. 7 is a sectional detail taken along lines 7-7 of FIG. 4.
Figure 6:
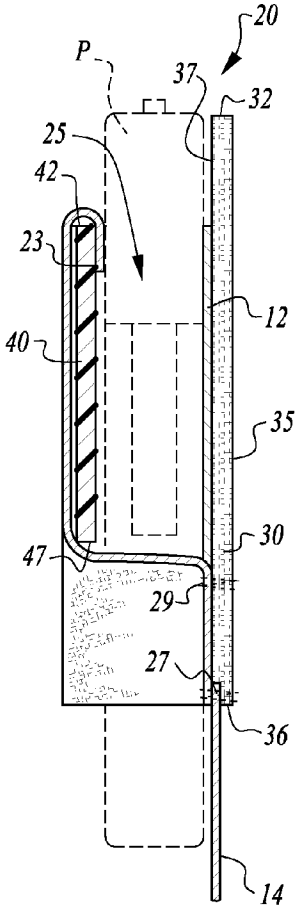
FIG. 6 is a sectional detail taken along lines 6-6 of FIG. 4.
Figure 5:
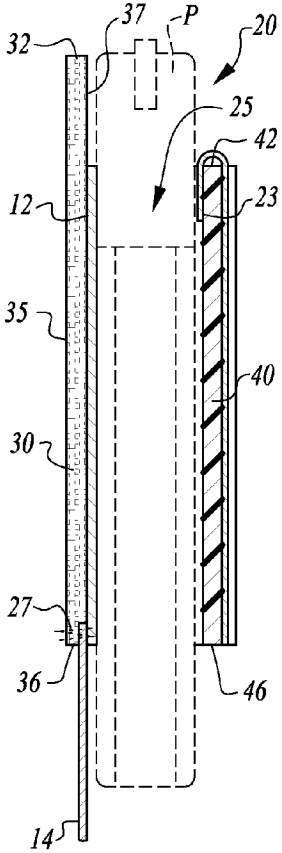
FIG. 5 is a sectional detail taken along lines 5-5 of FIG. 4.

These dimensions could also be adjustable in size, such as through a size adjustor 70, to accommodate magazines M of different sizes. For instance, complemental hook 72 and loop 74 fasteners (i.e. Velcro) could be provided facing each other at a transition point inside the magazine carrier 50. Short magazines SM (FIG. 8) would be supported above the transition point. Larger magazines M (FIG. 7) would be pushed (along arrow A of FIG. 7) between the complemental fasteners 72, 74 and go down to a bottom 58 of the magazine carrier 50. Strength of the complemental fasteners 72, 74 would be selected to resist opening sufficient to keep a short magazine SM from pushing past the transition point.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. An undergarment including a pistol holster therein, comprising in combination:

an undergarment including a waistband at an upper end thereof, said waistband forming a circuit of elastic material, said waistband adapted to gird a waist of a wearer;

a holster coupled to said waistband, said holster including a pouch having an open space between an inner layer and an outer layer;

said inner layer and said outer layer joined together at forward and rearward edges thereof and at least partially not joined together at upper and lower ends thereof defining a top opening and a bottom opening, said bottom opening smaller than said top opening;

padding located inward of said outer panel, said padding attached to said pouch at least indirectly and extending above said waistband;

wherein a magazine carrier is coupled to said waistband on a portion thereof spaced from said holster, said magazine carrier including a magazine pouch having an open space between an inner panel and an outer panel, said inner panel and said outer panel joined together at forward and rearward edges thereof and not joined together at an open top thereof and at least partially joined together at a closed bottom thereof; and wherein said magazine carrier includes complemental hook and loop fastener portions on opposite ones of said outer panel and said inner panel on portions of said outer panel and said inner panel adjacent each other, such that said complemental hook fastener and loop fastener can be selectively coupled or decoupled, with said hook and loop fasteners coupled together to shorten said magazine carrier and openable to deepen said magazine carrier.

2. The undergarment of claim 1 wherein an at least semi-rigid trigger guard having a contour similar to mid-portions of a pistol is located within said pouch of said holster.

3. The undergarment of claim 2 wherein said trigger guard has a lower end smaller than an upper end with said upper end of said trigger guard larger than said bottom opening.

4. The undergarment of claim 1 wherein said padding has a perimeter size at least as large as said outer layer of said pouch, said padding having a skin contacting surface with a soft texture.

5. The undergarment of claim 1 wherein said pouch has a perimeter defined by perimeter stitching joining said inner layer and said outer layer, said perimeter stitching extending substantially linearly from said top opening to said bottom opening on a first side of said pouch and extending non-linearly from said top opening to said bottom opening on a second side of said pouch opposite said first side of said pouch, said second side of said pouch including contour stitching on a portion thereof adjacent said bottom opening which is closer to said first side of said pouch than portions of said perimeter stitching on said second side of said pouch above said contour stitching.

6. The undergarment of claim 1 wherein a magazine carrier is coupled to said waistband on a portion thereof spaced from said holster, said magazine carrier including a magazine pouch having an open space between an inner panel and an outer panel, said inner panel and said outer panel joined together at forward and rearward edges thereof and not joined together at an open top thereof and at least partially joined together at a closed bottom thereof.

7. The undergarment of claim 6 wherein said magazine carrier includes padding located inward of said outer panel, said padding attached to said pouch of said magazine carrier at least indirectly and extending above said waistband.

8. An undergarment including a pistol holster therein, comprising in combination:

an undergarment including a waistband at an upper end thereof, said waistband forming a circuit of elastic material, said waistband adapted to gird a waist of a wearer;

a holster coupled to said waistband, said holster including a pouch having an open space between an inner layer and an outer layer;

said inner layer and said outer layer joined together at forward and rearward edges thereof and at least partially not joined together at upper and lower ends thereof defining a top opening and a bottom opening, said bottom opening smaller than said top opening; and an at least semi-rigid trigger guard having a contour similar to mid-portions of a pistol is located within said pouch of said holster.

9. The undergarment of claim 8 wherein padding is located inward of said outer panel, said padding attached to said pouch at least indirectly and extending above said waistband.

10. The undergarment of claim 9 wherein said padding has a perimeter size at least as large as said outer layer of said pouch, said padding having a skin contacting surface with a soft texture.

11. The undergarment of claim 8 wherein said trigger guard has a lower end smaller than an upper end with said upper end of said trigger guard larger than said bottom opening.

12. The undergarment of claim 8 wherein a magazine carrier is coupled to said waistband on a portion thereof spaced from said holster, said magazine carrier including a magazine pouch having an open space between an inner panel and an outer panel, said inner panel and said outer panel joined together at forward and rearward edges thereof and not joined together at an open top thereof and at least partially joined together at a closed bottom thereof.

13. The undergarment of claim 12 wherein said magazine carrier includes padding located inward of said outer panel, said padding attached to said pouch of said magazine carrier at least indirectly and extending above said waistband.

14. An undergarment including a pistol holster therein, comprising in combination:

an undergarment including a waistband at an upper end thereof, said waistband forming a circuit of elastic material, said waistband adapted to gird a waist of a wearer;

a holster coupled to said waistband, said holster including a pouch having an open space between an inner layer and an outer layer;

said inner layer and said outer layer joined together at forward and rearward edges thereof and at least partially not joined together at upper and lower ends thereof defining a top opening and a bottom opening, said bottom opening smaller than said top opening;

an at least semi-rigid trigger guard having a contour similar to mid-portions of a pistol is located within said pouch of said holster;

wherein a magazine carrier is coupled to said waistband on a portion thereof spaced from said holster, said magazine carrier including a magazine pouch having an open space between an inner panel and an outer panel, said inner panel and said outer panel joined together at forward and rearward edges thereof and not joined together at an open top thereof and at least partially joined together at a closed bottom thereof; and wherein said magazine carrier includes complemental hook and loop fastener portions on opposite ones of said outer panel and said inner panel on portions of said outer panel and said inner panel adjacent each other, such that said complemental hook fastener and loop fastener can be selectively coupled or decoupled, with said hook and loop fasteners coupled together to shorten said magazine carrier and openable to deepen said magazine carrier.

15. An undergarment including a pistol holster therein, comprising in combination:

an undergarment including a waistband at an upper end thereof, said waistband forming a circuit of elastic material, said waistband adapted to gird a waist of a wearer;

a holster coupled to said waistband, said holster including a pouch having an open space between an inner layer and an outer layer;

said inner layer and said outer layer joined together at forward and rearward edges thereof and at least partially not joined together at upper and lower ends thereof defining a top opening and a bottom opening, said bottom opening smaller than said top opening;

wherein a magazine carrier is coupled to said waistband on a portion thereof spaced from said holster, said magazine carrier including a magazine pouch having an open space between an inner panel and an outer panel, said inner panel and said outer panel joined together at forward and rearward edges thereof and not joined together at an open top thereof and at least partially joined together at a closed bottom thereof;

wherein a magazine carrier is coupled to said waistband on a portion thereof spaced from said holster, said magazine carrier including a magazine pouch having an open space between an inner panel and an outer panel, said inner panel and said outer panel joined together at forward and rearward edges thereof and not joined together at an open top thereof and at least partially joined together at a closed bottom thereof; and wherein said magazine carrier includes complemental hook and loop fastener portions on opposite ones of said outer panel and said inner panel on portions of said outer panel and said inner panel adjacent each other, such that said complemental hook fastener and loop fastener can be selectively coupled or decoupled, with said hook and loop fasteners coupled together to shorten said magazine carrier and openable to deepen said magazine carrier.

16. The undergarment of claim 15 wherein padding is located inward of said outer panel, said padding attached to said pouch at least indirectly and extending above said waistband.

17. The undergarment of claim 16 wherein said padding has a perimeter size at least as large as said outer layer of said pouch, said padding having a skin contacting surface with a soft texture.

18. The undergarment of claim 15 wherein an at least semi-rigid trigger guard having a contour similar to mid-portions of a pistol is located within said pouch of said holster.

19. The undergarment of claim 18 wherein said trigger guard has a lower end smaller than an upper end with said upper end of said trigger guard larger than said bottom opening.

* * * * *